US012054889B2

(12) United States Patent
Koivisto

(10) Patent No.: US 12,054,889 B2
(45) Date of Patent: Aug. 6, 2024

(54) DEVICES AND METHODS FOR LAYING SLEEPERS ON BALLAST-BEDS FOR RAILROAD CONSTRUCTION

(71) Applicant: Kallion Raide Oy, Helsinki (FI)

(72) Inventor: Mika Koivisto, Helsinki (FI)

(73) Assignee: Kallion Raide Oy, Helsinki (FI)

( * ) Notice: Subject to any disclaimer, the term of this patent is extended or adjusted under 35 U.S.C. 154(b) by 759 days.

(21) Appl. No.: 17/292,516

(22) PCT Filed: Nov. 29, 2019

(86) PCT No.: PCT/FI2019/050855
§ 371 (c)(1),
(2) Date: May 10, 2021

(87) PCT Pub. No.: WO2020/115358
PCT Pub. Date: Jun. 11, 2020

(65) Prior Publication Data

US 2021/0395955 A1 Dec. 23, 2021

(30) Foreign Application Priority Data

Dec. 5, 2018 (FI) ..... 20186054

(51) Int. Cl.
*E01B 29/06* (2006.01)
*E01B 29/05* (2006.01)
(Continued)

(52) U.S. Cl.
CPC ..... *E01B 29/06* (2013.01); *E01B 29/05* (2013.01); *E01B 29/09* (2013.01); *E01B 29/10* (2013.01); *E01B 29/13* (2013.01)

(58) Field of Classification Search
CPC ..... E01B 29/06; E01B 29/05; E01B 29/09; E01B 29/10; E01B 29/13
(Continued)

(56) References Cited

U.S. PATENT DOCUMENTS 3,547,266 A * 12/1970 Michel ..... E01B 29/06 414/338
4,392,433 A * 7/1983 Nyland ..... E01B 29/10 104/9
(Continued)

FOREIGN PATENT DOCUMENTS

CN 101144257 B 3/2008
CN 108842540 A * 11/2018 ..... E01B 29/10
(Continued)

OTHER PUBLICATIONS

Finnish Patent and Registration Office, Search Report, U.S. Appl. No. 20/186,054, mailed May 10, 2019, 1 page.
(Continued)

*Primary Examiner* — S. Joseph Morano
*Assistant Examiner* — James William Jones
(74) *Attorney, Agent, or Firm* — Ziegler IP Law Group, LLC.

(57) ABSTRACT

A device for laying sleepers on a ballast-bed for railroad construction includes a body having a commuting-mechanism and a fork-lift on a first side of the body The fork-lift lifts and holds at least one set of sleepers above the ballast-bed. A pair of pivot-arms are movably coupled the body and include a gripper. The gripper moves a set of sleepers from the fork-lift from the first side of the body towards a second side of the body. A cradle-arrangement mounted on the second side of the body and the commuting-mechanism allow movement of the device. The pair of elongated fixed support-members is configured to support the set of sleepers moved by the grippers The pair of movable support-members has a reciprocating-movement with respect to the pair of elongated fixed support-members to successively release one sleeper of the set of sleepers at a time from the pair of elongated fixed support-members.

14 Claims, 6 Drawing Sheets

(51) Int. Cl.

| | |
|---|---|
| ***E01B 29/09*** | (2006.01) |
| ***E01B 29/10*** | (2006.01) |
| ***E01B 29/13*** | (2006.01) |

(58) Field of Classification Search
USPC ..... 104/5, 6, 9
See application file for complete search history.

(56) References Cited

U.S. PATENT DOCUMENTS

| | | | | | |
|---|---|---|---|---|---|
| 5,100,278 | A * | 3/1992 | Westlake | B66C 23/50 | 104/5 |
| 5,904,098 | A * | 5/1999 | Theurer | B66C 23/50 | 414/547 |
| 8,443,733 | B2 * | 5/2013 | Coots | E01B 29/32 | 104/5 |

FOREIGN PATENT DOCUMENTS

| | | | | | |
|---|---|---|---|---|---|
| DE | 105015 | A1 | | 4/1974 | |
| GB | 2247265 | A | * | 2/1992 | E01B 29/10 |
| GB | 2274130 | A | * | 7/1994 | E01B 29/06 |
| GB | 2274130 | A | | 7/1994 | |
| JP | S53131670 | A | | 11/1978 | |
| JP | H06082102 | U1 | | 11/1994 | |
| SU | 388078 | A1 | | 6/1973 | |
| WO | 03069063 | A1 | | 8/2003 | |

OTHER PUBLICATIONS

International Search Report and Written Opinion of the International Searching Authority, Application No. PCT/FI2019/050855, mailed Mar. 11, 2020, 31 pages.
Japan Patent Office, 'Notification of ground of rejection', Jul. 19, 2023, Application No. 2021-523478.

* cited by examiner

DEVICES AND METHODS FOR LAYING SLEEPERS ON BALLAST-BEDS FOR RAILROAD CONSTRUCTION

TECHNICAL FIELD

The present disclosure relates generally to railways; and more specifically, to devices and methods for laying sleepers on ballast-beds for railroad construction.

BACKGROUND

In the recent past, travelling takes up a considerable part of a person's day. Considering the traffic conditions of present era, travelling via any means of transport, such as road vehicles, railways, airways, and so forth, is extremely strenuous and time-consuming. Amongst the aforesaid, railways are mostly preferred means for travelling, especially for long-distances and also in cases where travelling via road vehicles encounters enormous traffic. However, creating the travel pathway, railway-tracks in remote and extended stretches is far more challenging as compared to creating roads, flight paths and so forth.

Traditionally, railway construction employs laying and/or installing sleepers (namely, rails, ties) on a ballast-bed. Such laying and/or installation process requires lots of manual labour input for individually lifting the heavy sleepers and placing each of them on the ballast-bed. Notably, the sleepers are required to be laid and/or installed at equidistance with respect to each other, for ensuring proper and safe operation of the trains running on corresponding tracks. Consequently, the process of laying and/or installation work requires constant manual intervention to ensure the correct placement of the sleepers, such as, for determination of accurate position for laying each sleeper, adjustment of position of each sleeper with respect to a planned position of corresponding tracks, laying each sleeper parallel to each other, and so forth. Moreover, the traditional process of laying and/or installing sleepers can be expensive owing to manual labour and other costs associated therewith, as well as extensively time-consuming.

Document GB 2274130 discloses a sleeper laying machine comprising a chassis provided with road wheels, a dual chain storage conveyor extending along the chassis, and an inclined gravity conveyor at the rear of the chassis. The movement of the sleepers down the gravity conveyor is controlled by abutment arms projecting from endless chains supported above the gravity conveyor. Intermittent, synchronised operation of the gravity and storage conveyors is effected in response to a signal generated by a wheel which rolls along the track. Document SU 388078 presents a device for placing sleepers in a line, containing a frame movable on rollers, to the belts of which folding teeth located along the plot are attached, the sleeper and reciprocating sleeper mechanism being provided with a stop. In order to improve the performance of the line and reduce the metal capacity of the device, the roller frame is mounted on the upper surfaces of the rail soles inside the assembly line, and the spinner mounted on the rail head of the assembly line is designed as a stepped plate.

In the recent past, with advent of technology, new machines have been developed for building the railroad tracks. These machines enable the process of laying and/or installing sleepers in an automatic or semi-automatic manner. However, such installation process requires a number of machines to perform the desired task. Moreover, even such techniques do not perform with appreciable efficiency and/or flexibility for the required purpose.

Therefore, in light of the foregoing discussion, there exists a need to overcome the aforementioned drawbacks associated with the conventional machines and techniques used for laying sleepers on the ballast-bed for railroad construction.

SUMMARY

The present disclosure seeks to provide a device for laying sleepers on a ballast-bed for railroad construction. The present disclosure also seeks to provide a method for operating a device for laying sleepers on a ballast-bed for railroad construction.

The present disclosure seeks to provide a solution to the existing problem associated with conventional machines and techniques for laying sleepers on ballast-beds for railroad construction. An aim of the present disclosure is to provide a solution that overcomes at least partially the problems encountered in prior art and provide the device and the method to reduce time, effort and manual labour required for laying sleepers on ballast-beds for railroad construction.

In one aspect, an embodiment of the present disclosure provides a device for laying sleepers on a ballast-bed for railroad construction, the device comprising

- a body having a commuting-mechanism, wherein the commuting-mechanism is operable to allow movement of the device;
- a fork-lift arranged on a first side of the body, wherein the fork-lift is operable to lift and hold at least one set of sleepers above the ballast-bed;
- a pair of pivot-arms movably coupled to the body, wherein each of the pivot-arms comprises a gripper, and wherein the grippers of the pair of pivot-arms are operable to pick a set of sleepers from the fork-lift and to move the set of sleepers from the first side of the body towards a second side of the body opposite to the first side; wherein
- a cradle-arrangement mounted on the second side of the body, wherein the cradle-arrangement comprises
  - a pair of elongated fixed support-members extending from the second side of the body and spaced apart from each other; and
  - a pair of movable support-members, wherein each of the pair of movable support-members comprises a plurality of spring-loaded elements operable to attain a closed-state and a released-state, wherein the pair of movable support-members includes an extension plate for receiving a released sleeper during a forward phase, and wherein

- the pair of elongated fixed support-members is operable to support thereon, the set of sleepers moved by the grippers of the pair of the pivot-arms from the first side of the body towards the second side of the body; and
- the pair of movable support-members is operable to have a reciprocating-movement with respect to the pair of elongated fixed support-members to successively release one sleeper of the set of sleepers at a time from the pair of elongated fixed support-members.

In another aspect, an embodiment of the present disclosure provides a method for operating a device for laying sleepers on a ballast-bed for railroad construction, the device comprising a body having a commuting-mechanism; a fork-lift arranged on a first side of the body, wherein the fork-lift is operable to lift and hold at least one set of sleepers above the ballast-bed; a pair of pivot-arms movably coupled the body, wherein each of the pivot-arms comprises a gripper; a cradle-arrangement mounted on the second side of the body, the cradle-arrangement comprising a pair of elongated fixed support-members extending from the second side of the body and spaced apart from each other; and a pair of movable support-members, each of the movable support-members comprising a plurality of spring-loaded elements operable to attain a closed-state and a released-state, wherein the pair of movable support-members includes an extension plate for receiving a released sleeper during a forward phase.

The method comprises picking a set of sleepers from the fork-lift by the grippers of the pair of pivot-arms and moving the set of sleepers from the first side of the body towards a second side of the body opposite to the first side;

operating the commuting-mechanism to allow movement of the device;

supporting the set of sleepers moved by the grippers of the pair of the pivot-arms from the first side of the body towards the second side of the body, on the pair of elongated fixed support-members; and providing a reciprocating-movement to the pair of movable support-members with respect to the pair of elongated fixed support-members, to successively release one sleeper of the set of sleepers at a time from the pair of elongated fixed support-members.

Embodiments of the present disclosure substantially eliminate or at least partially address the aforementioned problems in the prior art, and enable a time efficient, inexpensive and an operation involving a least manual intervention.

Additional aspects, advantages, features and objects of the present disclosure would be made apparent from the drawings and the detailed description of the illustrative embodiments construed in conjunction with the appended claims that follow.

It will be appreciated that features of the present disclosure are susceptible to being combined in various combinations without departing from the scope of the present disclosure as defined by the appended claims.

BRIEF DESCRIPTION OF THE DRAWINGS

The summary above, as well as the following detailed description of illustrative embodiments, is better understood when read in conjunction with the appended drawings. For the purpose of illustrating the present disclosure, exemplary constructions of the disclosure are shown in the drawings. However, the present disclosure is not limited to specific methods and instrumentalities disclosed herein. Moreover, those skilled in the art will understand that the drawings are not to scale. Wherever possible, like elements have been indicated by identical numbers.

Embodiments of the present disclosure will now be described, by way of example only, with reference to the following diagrams wherein.

Figure 1:
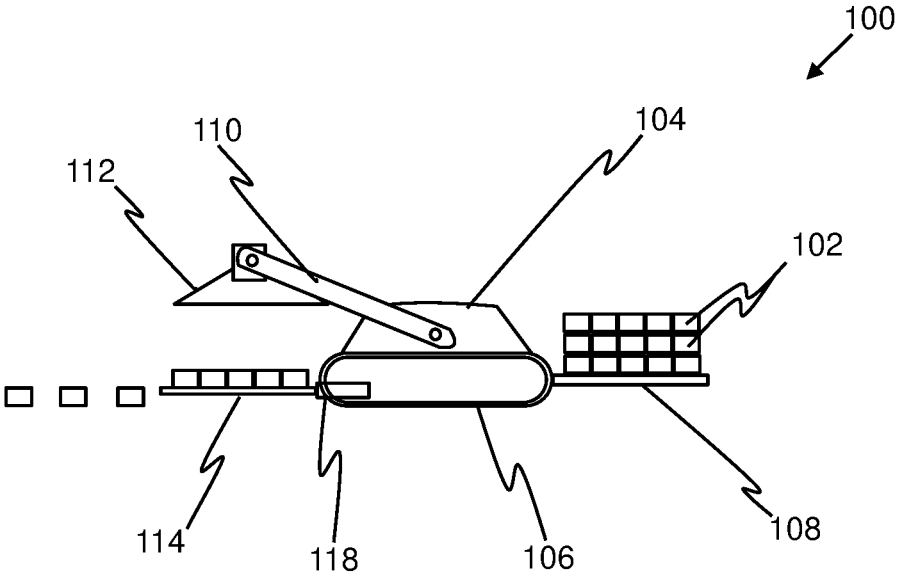
FIG. 1 is a side view of a device for laying sleepers on a ballast-bed for railroad construction, in accordance with an embodiment of the present disclosure.

In the accompanying drawings, an underlined number is employed to represent an item over which the underlined number is positioned or an item to which the underlined number is adjacent. A non-underlined number relates to an item identified by a line linking the non-underlined number to the item. When a number is non-underlined and accompanied by an associated arrow, the non-underlined number is used to identify a general item at which the arrow is pointing.

DETAILED DESCRIPTION OF EMBODIMENTS

The following detailed description illustrates embodiments of the present disclosure and ways in which they can be implemented. Although some modes of carrying out the present disclosure have been disclosed, those skilled in the art would recognize that other embodiments for carrying out or practising the present disclosure are also possible.

In one aspect, an embodiment of the present disclosure provides a device for laying sleepers on a ballast-bed for railroad construction, the device comprising a body having a commuting-mechanism, wherein the commuting-mechanism is operable to allow movement of the device;

a fork-lift arranged on a first side of the body, wherein the fork-lift is operable to lift and hold at least one set of sleepers above the ballast-bed;

a pair of pivot-arms movably coupled to the body, wherein each of the pivot-arms comprises a gripper, and wherein the grippers of the pair of pivot-arms are operable to pick a set of sleepers from the fork-lift and to move the set of sleepers from the first side of the body towards a second side of the body opposite to the first side; wherein a cradle-arrangement mounted on the second side of the body, wherein the cradle-arrangement comprises a pair of elongated fixed support-members extending from the second side of the body and spaced apart from each other; and a pair of movable support-members, wherein each of the pair of movable support-members comprises a plurality of spring-loaded elements operable to attain a closed-state and a released-state, wherein the pair of movable support-members includes an extension plate for receiving a released sleeper during a forward phase, and wherein the pair of elongated fixed support-members is operable to support thereon, the set of sleepers moved by the grippers of the pair of the pivot-arms from the first side of the body towards the second side of the body; and the pair of movable support-members is operable to have a reciprocating-movement with respect to the pair of elongated fixed support-members to successively release one sleeper of the set of sleepers at a time from the pair of elongated fixed support-members.

In another aspect, an embodiment of the present disclosure provides a method for operating a device for laying sleepers on a ballast-bed for railroad construction, the device comprising a body having a commuting-mechanism; a fork-lift arranged on a first side of the body, wherein the fork-lift is operable to lift and hold at least one set of sleepers above the ballast-bed; a pair of pivot-arms movably coupled the body, wherein each of the pivot-arms comprises a gripper; a cradle-arrangement mounted on the second side of the body, the cradle-arrangement comprising a pair of elongated fixed support-members extending from the second side of the body and spaced apart from each other; and a pair of movable support-members, each of the movable support-members comprising a plurality of spring-loaded elements operable to attain a closed-state and a released-state, wherein the pair of movable support-members includes an extension plate for receiving a released sleeper during a forward phase.

The method comprises picking a set of sleepers from the fork-lift by the grippers of the pair of pivot-arms and moving the set of sleepers from the first side of the body towards a second side of the body opposite to the first side;

operating the commuting-mechanism to allow movement of the device;

supporting the set of sleepers moved by the grippers of the pair of the pivot-arms from the first side of the body towards the second side of the body, on the pair of elongated fixed support-members; and providing a reciprocating-movement to the pair of movable support-members with respect to the pair of elongated fixed support-members, to successively release one sleeper of the set of sleepers at a time from the pair of elongated fixed support-members.

The present disclosure provides a device for laying sleepers on a ballast-bed for railroad construction. Furthermore, the present disclosure provides a method for laying sleepers on a ballast-bed for railroad construction using the aforementioned device. The device automatically releases sleepers therefrom after predefined distance from each other. Thus, effort exerted in lifting and placing the sleepers at equal distances with respect to each other by labourers is saved as the device requires no or negligible manual intervention. The device eliminates a requirement of a plurality of machines for laying the sleepers, such as a carriage-mechanism for carrying the sleepers to their intended location, a crane for lifting the sleepers, and so forth. Consequently, the requirement of labourers for operating each of the plurality of machines is reduced and therefore, laying the sleepers using the device is inexpensive as less manual intervention ensures less labour cost. Furthermore, laying of sleepers by manual labourers may lead to inaccurate placement thereof, thus, hindering proper and safe operation of the trains running on corresponding tracks. The device and the method enable an accurate placement of the sleepers such that the sleepers are laid at an equal distance with respect to each other, therefore, ensuring safe, proper and time-efficient operation of trains running on corresponding railway-tracks.

The device comprises a body having a commuting-mechanism. The body can be implemented as an enclosure for housing one or more components of the device, such as one or more electronic and/or mechanical components of the device. For example, the one or more components enclosed by the body can comprise a powertrain for enabling operation of the commuting-mechanism.

The commuting-mechanism comprises a commuting mechanism, i.e. components for enabling movement of the device over a ballast-bed. For example, the commuting-mechanism can comprise a wheel arrangement that is driven using the powertrain (as mentioned hereinabove). In an embodiment, the commuting-mechanism comprises at least one of a plurality of drive-wheels or a caterpillar-track arrangement. For example, the commuting-mechanism comprises at least two wheels on each of left side and right side of the body of the device, wherein the wheels on each side are circumferentially enclosed by the caterpillar-tracks. Such caterpillar-tracks can be fabricated using a steel material, stainless steel material, synthetic rubber material and so forth.

Furthermore, the device comprises a fork-lift arranged on a first side of the body, wherein the fork-lift is operable to lift and hold at least one set of sleepers above the ballast-bed. The set of sleepers comprises a plurality of sleepers arranged in sets, wherein each set comprises a specific number of sleepers. Furthermore, such plurality of set of sleepers can be placed on the ballast-bed prior to commencement of operation of the device and in a path of movement of the device over the ballast-bed. It will be appreciated that, as the device moves in proximity to the plurality of set of sleepers placed on the ballast-bed, the fork-lift is operable to lift at least one set of sleepers from the plurality of set of sleepers above the ballast-bed and hold (such as support) the at least one set of sleepers. Further, the fork-lift can be arranged to lift and move at least one set of sleepers in side direction in relation to the rail road to be build. Furthermore, there might be a supporting pallet between the at least one set of sleepers and the ballast-bed to enable forks of the fork-lift to lift from a bottom of the set.

The device comprises a pair of pivot-arms movably coupled to the body, wherein each of the pair of pivot-arms comprises a gripper. Typically, the pivot-arms are couples to an intermediate portion of the body. The pair of pivot-arms can for example be pivotally coupled to the intermediate portion of the body and each of the pair of pivot-arms are coupled to each of the left side and the right side of the body of the device respectively. In an embodiment, each of the pair of pivot-arms includes a first end movably coupled to the intermediate portion of the body, and a second end mounted with the gripper. The pair of pivot-arms comprises the gripper mounted at the first end thereof, such as, at a free-end of each of the pair of pivot-arms and another end (or the second end) of the pair of pivot-arms is pivotally coupled to the intermediate portion of the body. The grippers of the pair of pivot-arms are operable to pick a set of sleepers from the fork-lift and to move the set of sleepers from the first side of the body towards a second side of the body opposite to the first side. The grippers of the pair of pivot-arms are associated with a width and a tensile strength that enables the set of sleepers to be lifted by the grippers from the fork-lift. In an example, each gripper comprises an L-shaped component at a lower end thereof. In such an example, the grippers are operable to pick the set of sleepers from the fork-lift by sliding a short-arm of the L-shaped component under the set of sleepers and subsequently, vertically lifting the set of sleepers. Thereafter, the pair of pivot-arms are operable to pivot about the intermediate portion of the body, thereby moving the set of sleepers from the first side of the body (such as a front of the body) towards the second side of the body (such as a rear of the body) opposite to the first side.

Furthermore, the device comprises a cradle-arrangement mounted on the second side of the body (such as a rear of the body). The cradle-arrangement comprises a pair of elongated fixed support-members extending from the second side of the body and spaced apart from each other. The pair of elongated fixed support-members can be implemented as horizontal members arranged towards a lower-end on the second side of the body. Moreover, each of the pair of elongated fixed support-members are arranged opposite to each other, such as, one of the elongated fixed support-members is arranged towards the left-side of the body at the second side (such as a rear of the body) thereof and another elongated fixed support-member is arranged towards the right-side of the body at the second side thereof. Furthermore, the elongated fixed support-members are arranged to be spaced apart from each other. For example, the elongated fixed support-members are spaced apart from each other by a distance that can be slightly smaller than a length of the sleepers, such that the sleepers are supported by their ends.

The cradle-arrangement comprises a pair of movable support-members, wherein each of the movable support-members comprises a plurality of spring-loaded elements operable to attain a closed-state or a released-state. The pair of movable support-members is arranged such that a horizontal position of each of the movable support-members substantially corresponds to a horizontal position of each of the pair of elongated fixed support-members. However, the pair of movable support-members is arranged such that a gap is formed, vertically, between the pair of elongated fixed support-members and the pair of movable support-members to allow relative movement therebetween. Furthermore, such a gap may be formed such that a plane of the pair of elongated fixed support-members that the sleeper is placed thereon, is substantially coplanar with a plane of the movable support-members (when each of the plurality of spring-loaded elements are in a closed-state thereof, explained in detail herein later) that is adjacent to a lower plane of the set of sleepers supported on the cradle-arrangement. Moreover, each movable support-member comprises the plurality of spring-loaded elements, such that the plurality of spring-loaded elements are linearly arranged between a pair of planar elements having a same vertical height as the plurality of spring-loaded elements. Moreover, each spring-loaded element is operable to attain both the closed-state and the released-state.

In one embodiment, each of the plurality of spring-loaded elements comprises a hollow body, a pusher arm pivotally coupled to the hollow body, and a spring coupled to each of the hollow body and the pusher arm. The spring-loaded element transmits the pushing force applied thereto, to the sleepers for movement thereof and for placement thereof on the ballast-bed. Furthermore, the each of the plurality of spring-loaded elements comprises the hollow body, such as a cuboidal-body that is open from a top thereof and hollow inside. Moreover, a width of the hollow body may correspond to a width of each sleeper of the set of sleepers. The spring-loaded elements typically comprise the pusher arm pivotally coupled to a rear end of the hollow body and the spring. The spring can be attached to an intermediate portion of the inside of the hollow body and a corresponding area of an underside of the pusher arm. The spring-loaded element attains the closed-state when the spring contracts and the pusher arm is pivotally lowered towards the hollow body. The spring of each of the plurality of spring-loaded elements is associated with a spring constant, such that a spring force applied by the spring when a sleeper is placed on the corresponding spring-loaded element, balances (or is substantially equivalent to) a weight of the sleeper. In such an instance, the spring contracts, the pusher arm is pivotally lowered such that the pusher arm is completely housed within the hollow body of the spring-loaded element and the spring-loaded element attains the closed-state. Furthermore, the spring-loaded element attains the released-state when the spring expands and the pusher arm is pivotally raised away from the hollow body. It will be appreciated that, as the spring constant of the spring enables the spring to be compressed when the sleeper is placed on the pusher arm, when the pusher arm is not placed on the pusher arm, the spring force of the spring is not balanced (or counteracted) by the weight of the sleeper. Consequently, the spring expands and the pusher arm is pivotally pushed upwards away from the housing of the hollow body and thus, the spring-loaded element attains the released-state. In one embodiment, an angle of the pusher arm with respect to the hollow body when the spring-loaded element is placed on a horizontal surface and the spring-loaded element has been allowed to attain the released-state, is in a range of 30° to 60°. For example, such an angle can be from 30, 35, 40, 45 or 50 degrees up to 40, 45, 50, 55 or 60 degrees.

The pair of movable support-members is operable to support thereon the set of sleepers moved by the grippers of the pair of the pivot-arms from the first side of the body towards the second side of the body. It will be appreciated that, as the vertical gap is formed between the pair of elongated fixed support-members and the pair of movable support-members, the set of sleepers are supported on only the pair of elongated fixed support-members. Consequently, there can be relative movement between the sleepers and the pair of movable support-members.

The commuting-mechanism is operable to allow movement of the device, for example for a first period of time and maintain the device in a stationary position for a second period of time. Indeed, according to an embodiment, for a first period of time the commuting mechanism is configured to move the device at a set first speed and the reciprocating movement has a set frequency. According to another embodiment, the commuting mechanism is configured to move the device for a first period of time, and maintain the device in a stationary position for a second period of time and the reciprocating movement is configured to take place during the second period of time.

It has indeed been found that the movement of the device via the commuting mechanism and subsequently, maintaining the device in the stationary position for the second period of time, enables to place the sleepers at fixed distances from each other. The sleeper is placed when the device is maintained in the stationary position for the second period of time and subsequently, the device is allowed to move to a position wherein another sleeper is required to be placed, such movement of the device corresponding to the first period of time. The movement of the device and subsequently maintaining the device in the stationary position is performed until all sleepers of the at least one set of sleepers have been placed. In an embodiment, the first period of time when the device is allowed to move is changed via the commuting-mechanism, to change a distance between release of each successive sleeper of the set of sleepers from the pair of elongated fixed support-members. For example, when a distance between placement of successive sleepers is required to be changed, the first period of time when the commuting-mechanism allows the device to move, can be changed.

The pair of movable support-members is operable to have a reciprocating-movement with respect to the pair of elongated fixed support-members to successively release one sleeper of the set of sleepers at a time from the pair of elongated fixed support-members. For example, a sleeper is released when the device is maintained in the stationary position, after each successive reciprocating-movement of the pair of movable support-members. Each sleeper is released at its turn. The pair of movable support-members is operable to have the reciprocating-movement, such that both the movable support-members simultaneously move towards the body of the device (referred to as the backward phase of the reciprocating movement), or towards the distal end of the pair of elongated fixed support-members (referred to as the forward phase of the reciprocating movement). Furthermore, after completion of each successive reciprocating movement (or one cycle of backward phase and the corresponding forward phase of the reciprocating movement), one sleeper of the set of sleepers would have been released from the pair of elongated fixed support-members, until all the sleepers supported on the pair of elongated fixed support-members have been released from the cradle-arrangement. Moreover, the sleeper is released from the cradle-arrangement when the device is maintained in the stationary position.

In another embodiment the device is configured to move at a set first speed. The frequency (i.e. how many times per minute a sleeper is released) of the reciprocating movement can be configured. A distance between two sleepers is a function of the set first speed and the frequency. As an example, if the device moves with speed of 10 meter per minute and frequency of the reciprocating movement is 20 times per minute, there will be a sleeper placed on the ground at equal distances of 50 cm from each other. In an alternative embodiment a distance from previous sleeper is measured before activating the reciprocating movement to control distances between the sleepers. Further, the device can comprise a speedometer or distance monitoring means (such as laser, a camera etc.).

In an embodiment, the device further comprises at least one actuator operatively coupled to each of the pair of movable support-members, for providing the reciprocating-movement to the pair of movable support-members. Such an actuator provides a pulling and a pushing force for enabling the backward phase and the forward phase of the reciprocating movement respectively, of each of the pair of movable support-members with respect to the pair of elongated fixed support-members. In one embodiment, the at least one actuator is a hydraulic actuator. Alternatively, the at least one actuator is a pneumatic actuator (for example, a pneumatic actuator that is provided with a speed-control valve).

According to an embodiment, during a forward phase of the reciprocating-movement of the pair of movable support-members, a sleeper supported by the pair of elongated fixed support-members (typically at a distal end thereof) is released by the pair of movable support-members, directly onto the ballast-bed. This is achieved by a simple pushing force of the movable support members.

During a forward phase of the reciprocating-movement of the pair of movable support-members, a sleeper supported by the pair of elongated fixed support-members (for example at a distal end thereof) is released by the pair of movable support-members onto an extension plate of the movable support-members, and during a backward phase of the reciprocating-movement of the pair of movable support-members, the pair of movable support-members retract towards the body, thus releasing the sleeper onto the ballast-bed. Indeed, the pair of movable support-members comprises an extension plate for receiving a released sleeper during the forward phase. As mentioned hereinabove, the pair of movable support-members are operable to reciprocate with respect to the pair of elongated fixed support-members. Furthermore, during the forward phase of the reciprocating-movement, the pair of movable support-members are operable to move such that the set of sleepers supported on the pair of elongated fixed support-members (such as, a sleeper supported on the elongated fixed support-members farthest from the body) are pushed until the sleeper supported at the distal end of the pair of elongated fixed support-members is pushed-off therefrom. It will be appreciated that, as each sleeper of the set of sleepers is released, the set of sleepers will be moved closer towards the distal end of the pair of elongated fixed support-members. Consequently, the reciprocating movement of the pair of movable support-members is adjusted such that the pair of movable support-members travel an additional distance during each successive reciprocating movement, until all sleepers of the set of sleepers have been released from the elongated fixed support-members. Furthermore, during the backward phase of the reciprocating-movement of the pair of movable support-members, the movable support-members are operable to retract towards the body of the device (or the pair of movable support-members "reset"), to perform a successive reciprocating-movement.

In one embodiment, during the forward phase of the reciprocating-movement of the pair of movable support-members, at least one pair of the spring-loaded elements is allowed to attain the released-state for enabling release of the sleeper supported at the distal end of the pair of elongated fixed support-members and remaining spring-loaded elements remain in the closed-state, and during the backward phase of the reciprocating-movement of the pair of movable support-members, another pair from the remaining spring-loaded elements in the closed-state is allowed to attain the released-state for enabling release of the remaining at least one sleeper of the set of sleepers. The set of sleepers can be arranged on the pair of elongated fixed support-members, such that a spring-loaded element closest to the body of the device is always maintained in the released-state. Consequently, a number of the plurality of spring-loaded elements on each movable support-member will be more than a number of sleepers in the at least one set of sleepers. Furthermore, during the forward phase of the reciprocating-movement of the pair of movable support-members, the spring-loaded element closest to the body acts as a "pushing element", such as, the spring-loaded element transmits the pushing force applied by the at least one actuator to the set of sleepers supported on the pair of elongated fixed support-members, until the sleeper at the distal end of the pair of elongated fixed support-members is released therefrom. Subsequently, the pair of movable support-members perform the backward phase of the reciprocating movement, wherein the pair of movable support-members retract towards the body of the device. It will be appreciated that, due to the vertical gap formed between the pair of movable support-members and the pair of elongated fixed support-members, the pair of movable support-members can move towards the body without disturbing a position of the set of sleepers on the pair of elongated fixed support-members, during the backward phase of the reciprocating-movement.

Thereafter, as the set of sleepers are moved on the pair of elongated fixed support-members, by a distance corresponding to the width of each sleeper, as the pair of movable support-members attain an initial position thereof (or a position closest to the body of the device) a spring-loaded element that is next to the spring-loaded element closest to the body, will not have a sleeper corresponding to a position thereof. Subsequently, the spring-loaded element is allowed to attain the released-state and consequently, the corresponding spring-loaded element acts as the pushing element. It will be appreciated that such reciprocating-movement of the pair of movable support-members is repeated until all spring-loaded elements have attained the released-state, wherein such attainment of the released-state of all the spring-loaded elements will correspond to release of all sleepers from the set of sleepers supported on the pair of elongated fixed support-members. Furthermore, the cradle-arrangement comprising the elongated fixed support-members and the movable support-members, is fabricated to have a low elevation with respect to the ballast-bed. Consequently, the sleepers are released from the low elevation, thereby, substantially minimizing unrequired movement of the sleeper after the sleeper makes contact with the ballast-bed.

In one embodiment, the fork-lift is operable to lift another set of sleepers above the ballast-bed to be received by the grippers of the pair of pivot-arms, before a last sleeper of the set of sleepers supported on the pair of elongated fixed support-members has been released. It will be appreciated that as soon as the last sleeper of the set of sleepers has been released from the cradle-arrangement, another set of sleepers will be required to be placed thereon. In such an instance, the fork-lift is operable to lift another set of sleepers above the ballast-bed prior to the last sleeper of the set of sleepers has been released. Consequently, the pair of pivot-arms are operable to move the other set of sleepers from the first side to the second side of the body of the device. Subsequently, the grippers of the pair of pivot-arms are operable to place the set of sleepers on the pair of elongated fixed support-members, as soon as the pair of movable support-members completes the backward phase of the reciprocating-movement after release of the last sleeper. It will be appreciated that, when the other set of sleepers are placed on the pair of elongated fixed support-members, the spring-loaded elements thereof are operable to attain the closed-state from the released-state thereof. However, as mentioned hereinabove, the spring-loaded element closest to the body of the device is always maintained in the released-state.

The present disclosure also relates to the method for operating a device for laying sleepers on a ballast-bed for railroad construction, as described above. Various embodiments and variants disclosed above apply mutatis mutandis to the method.

In an embodiment, the method comprises releasing by the pair of movable support-members a sleeper supported at a distal end of the pair of elongated fixed support-members, during a forward phase of the reciprocating-movement of the pair of movable support-members, and—retracting the pair of movable support-members towards the body, during a backward phase of the reciprocating-movement of the pair of movable support-members.

According to one embodiment, the method comprises allowing at least one pair of the spring-loaded elements to attain the released-state during the forward phase of the reciprocating-movement of the pair of movable support-members, for enabling release of the sleeper supported at the distal end of the pair of elongated fixed support-members, and simultaneously maintaining the remaining spring-loaded elements in the closed-state; and allowing another pair from the remaining spring-loaded elements in the closed-state to attain the released-state during the backward phase of the reciprocating-movement of the pair of movable support-members, for enabling release of the remaining at least one sleeper of the set of sleepers.

In an embodiment, the device further comprises at least one actuator operatively coupled to each of the pair of movable support-members, and wherein the method comprises operating the actuator for providing the reciprocating-movement to the pair of movable support-members.

In one embodiment, the fork-lift is operated to lift another set of sleepers above the ballast-bed to be received by the grippers of the pair of pivot-arms, before a last sleeper of the set of sleepers supported on the pair of elongated fixed support-members has been released.

According to one embodiment, the method further comprises changing the first period of time when the device is allowed to move via the commuting-mechanism, to change a distance between release of each successive sleeper of the set of sleepers from the pair of elongated fixed support-members.

DETAILED DESCRIPTION OF THE DRAWINGS

Referring to FIG. 1, there is shown a side view of a device 100 for laying sleepers 102 on a ballast-bed for railroad construction, in accordance with an embodiment of the present disclosure. The device 100 comprises a body 104 having a commuting-mechanism 106 and a fork-lift 108 arranged on a first side of the body 104. The device 100 further comprises a pair of pivot-arms 110 movably coupled to the body, wherein each of the pair of pivot-arms 110 comprises a gripper 112. Moreover, the device 100 comprises a cradle-arrangement 114 mounted on a second side of the body. Furthermore, the device 100 comprises two actuators 118.

Figure 2:
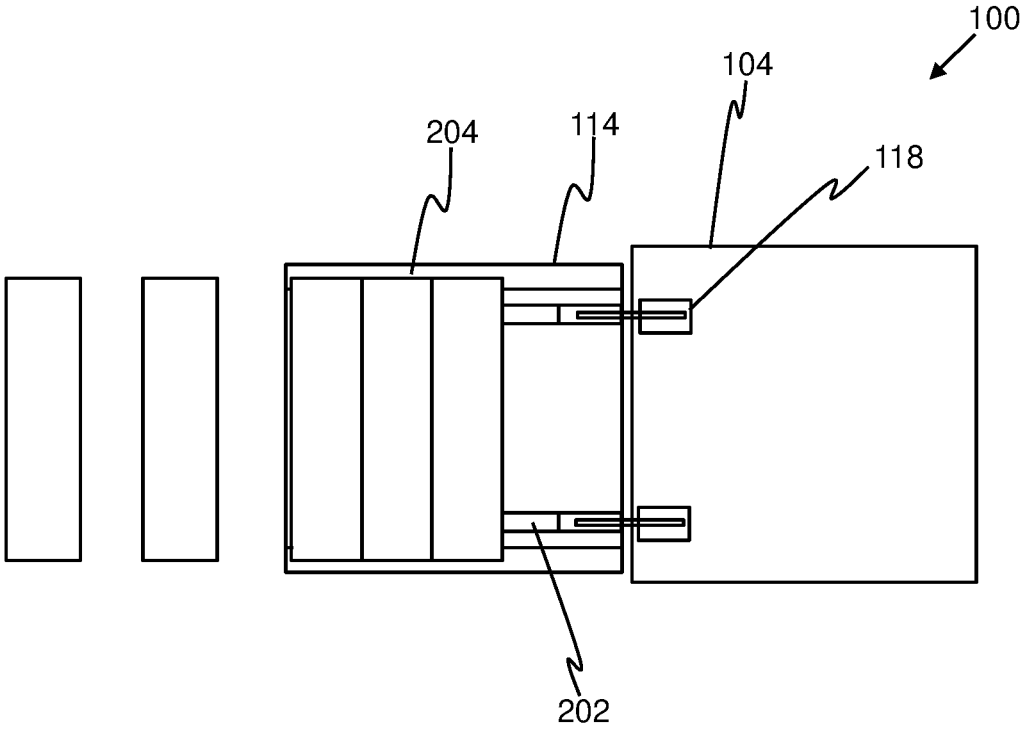
FIG. 2 is a top view of the device (as shown in FIG. 1), in accordance with an embodiment of the present disclosure.

Referring to FIG. 2, there is shown a top view of the device 100 of FIG. 1, in accordance with an embodiment of the present disclosure. The device 100 comprises the body 104 and the cradle-arrangement 114. The cradle-arrangement 114 comprises a pair of elongated fixed support-members 204 extending from the second side of the body and spaced apart from each other. Moreover, the cradle-arrangement 114 comprises a pair of movable support-members 202, wherein each of the movable support-members comprises a plurality of spring-loaded elements. Furthermore, the device comprises two actuators 118.

Referring to FIGS. 3A-D, there are shown schematic illustrations of a device 300 (similar to the device 100 of FIGS. 1 and 2) for laying sleepers 318A-C on a ballast-bed 320 for railroad construction, in operation, in accordance with an embodiment of the present disclosure. The device 300 comprises a body 302 (similar the body 104 of FIGS. 1 and 2) and a cradle-arrangement 304 (similar to the cradle-arrangement 114 of FIGS. 1 and 2). The cradle-arrangement 304 comprises a pair of elongated fixed support-members 306 (similar to the pair of elongated fixed support-members 204 of FIG. 2) and a pair of movable support-members 308 (similar to the pair of movable support-members 202 of FIG. 2). As shown, the pair of movable support-members 308 is operatively coupled to an actuator 310. Furthermore, each of the movable support-members 308 comprises a plurality of spring-loaded elements 330A-C and each of the plurality of spring-loaded elements 330A-C includes a hollow body 312, a pusher arm 314, a spring 316 and an axis as a pivoting point 317.

Figure 3A:
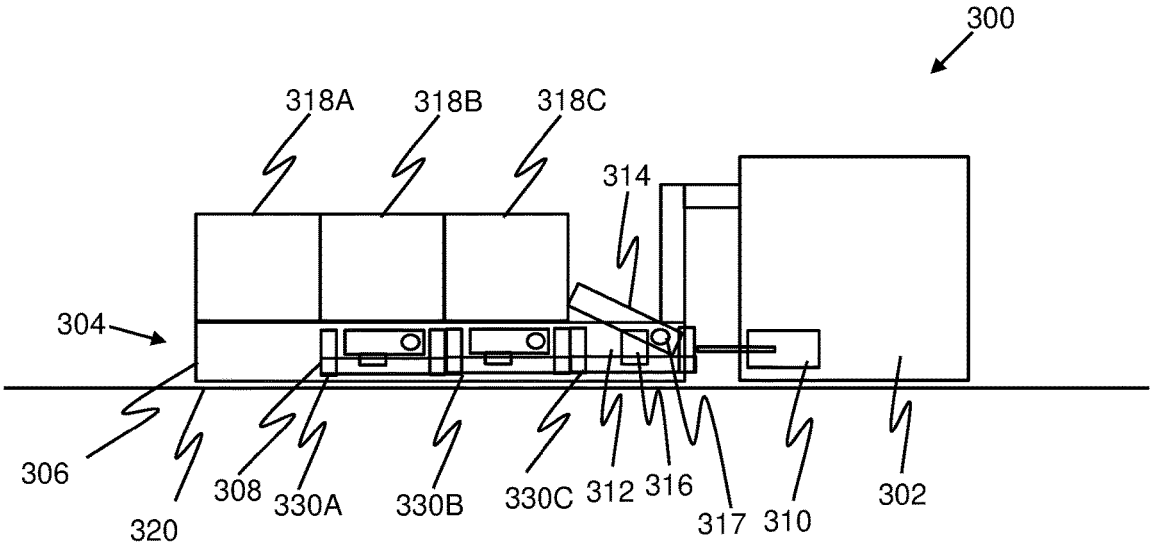
FIGS. 3A-D are schematic illustrations of a device (as shown in FIG. 1) in operation, in accordance with an exemplary embodiment of the present disclosure.

Referring to FIG. 3A, three sleepers 318A-C are supported on the pair of elongated fixed support-members 306. Furthermore, the spring-loaded elements 330A-C attain a closed-state when the three sleepers 318A, 318B and 318C are placed on the pair of elongated fixed support-members 306. Moreover, a spring-loaded element 330C of the plurality of spring-loaded elements 330A-C that does not support any of the sleepers 318A-C (and is closest to the body 302 of the device 300) is always maintained in a released-state.

Figure 3B:
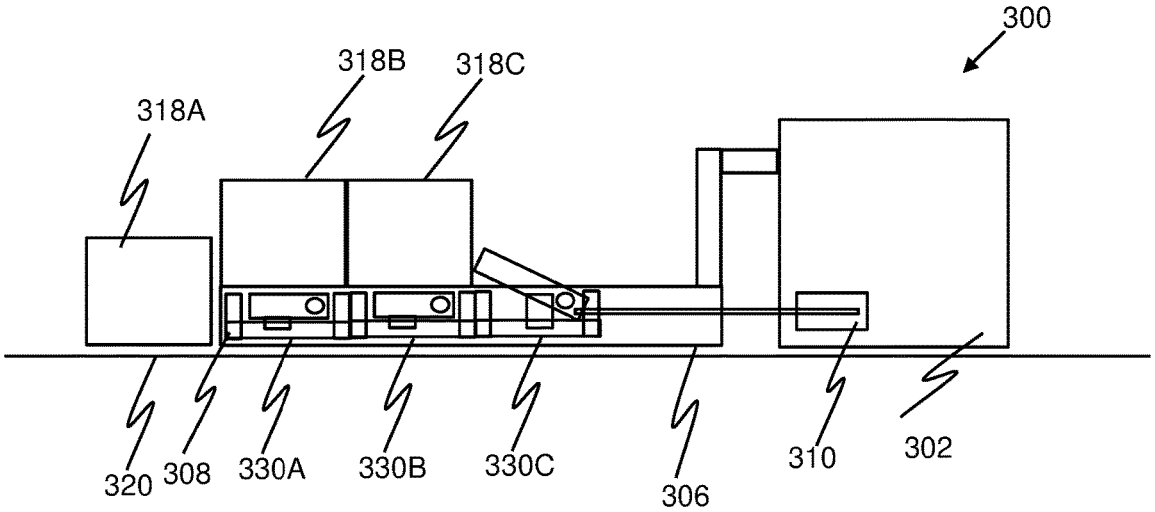

Referring now to FIG. 3B, there is shown a forward phase of a reciprocating-movement of the pair of movable support-members 308, wherein the pair of movable support-members 308 moves the three sleepers 318A-C towards a distal end of the pair of elongated fixed support-members 306. As shown, the sleeper 318A is released from the pair of elongated fixed support-members 306. Furthermore, the position of the sleepers 318B and 318C corresponding to the plurality of spring-loaded elements 330A-C is such that the spring-loaded elements 330A and 330B remain in the closed-state.

Figure 3C:
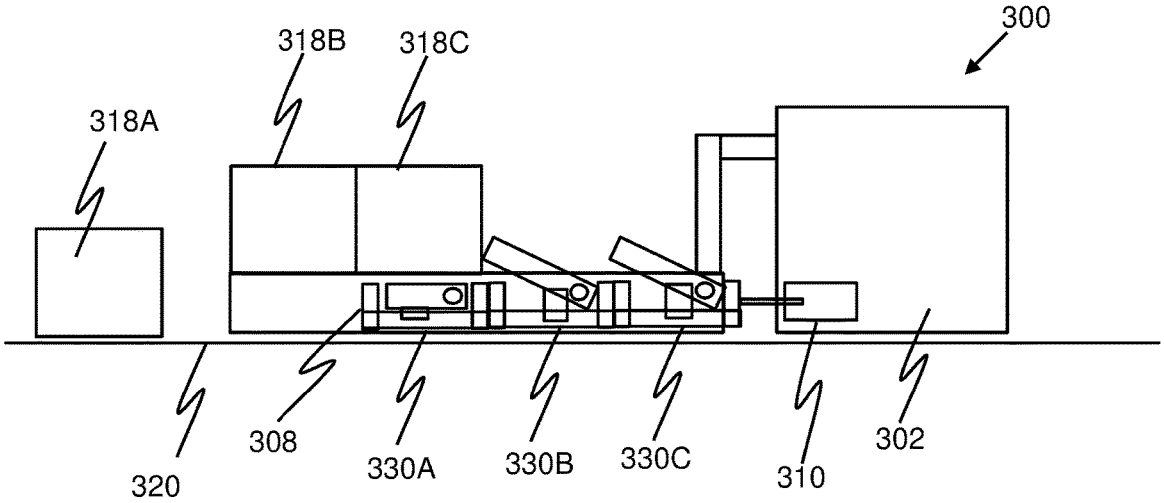

Referring now to FIG. 3C, there is shown a backward phase of the reciprocating-movement of the pair of movable support-members 308. As shown, the spring-loaded element 330C that does not correspond to the position of any of the sleepers 318B and 318C attains the released-state.

Figure 3D:
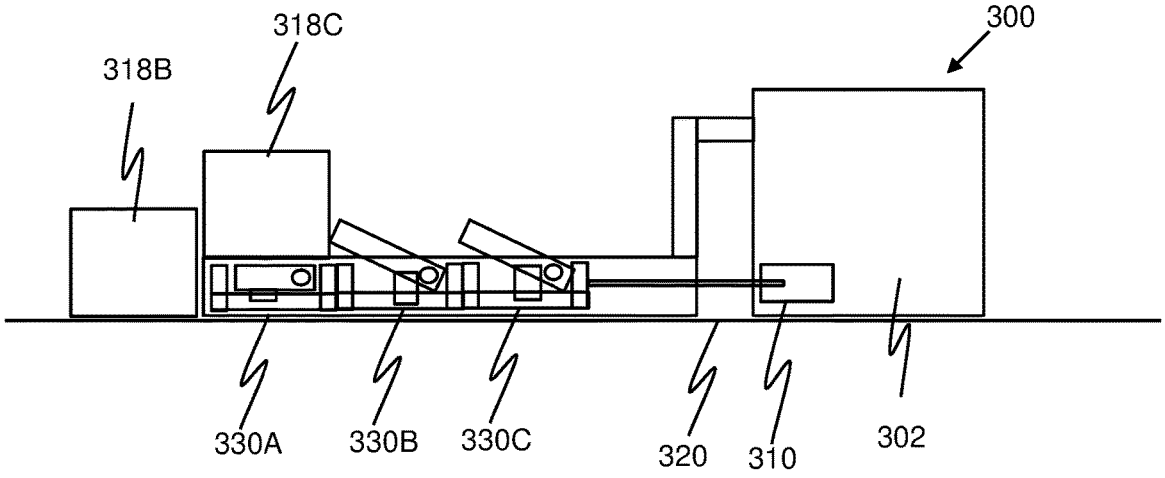

Referring now to FIG. 3D, there is shown a forward phase of a subsequent reciprocating-movement of the pair of movable support-members 308. The sleepers 318B-C are pushed towards the distal end of the pair of elongated fixed support-members 306, such that the sleeper 318B is released from the pair of elongated fixed support-members 306 and subsequently attains a tilted position in order to be laid on the ballast-bed for railroad construction. It is good to note that position of the device 300 in FIG. 3A, 3B, 3C and 3D in respect to ground is assumed to move with speed v to the right and reciprocating movement to have a frequency f. In practical terms, sleepers 318A, 318B and 318C will be thus distributed at set distance d from each other of d=v/f.

Figure 4A:
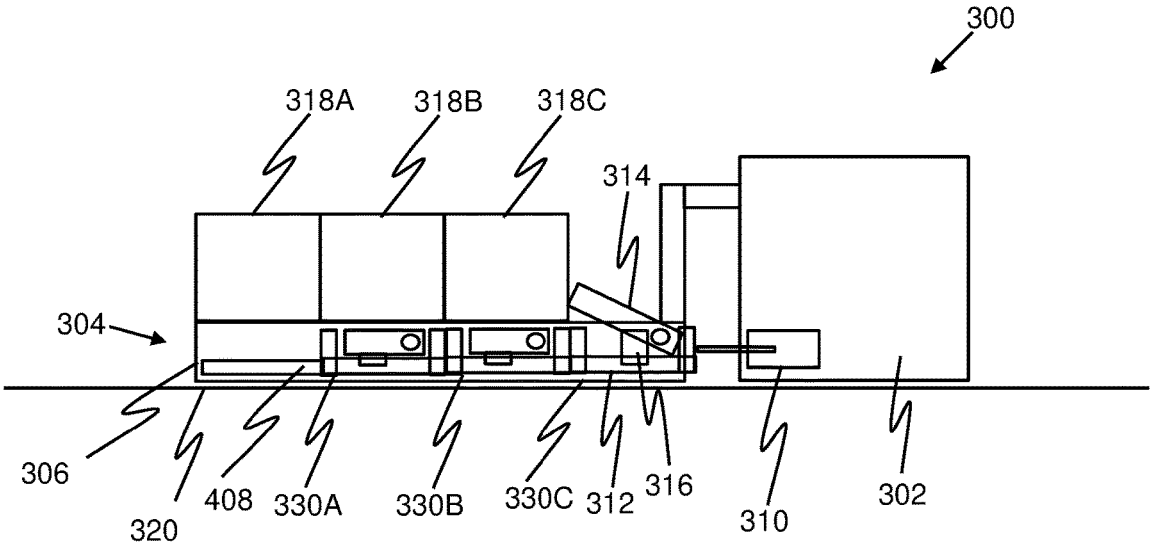
FIGS. 4A-C are schematic illustrations of a device in operation, in accordance with another exemplary embodiment of the present disclosure
Figure 4B:
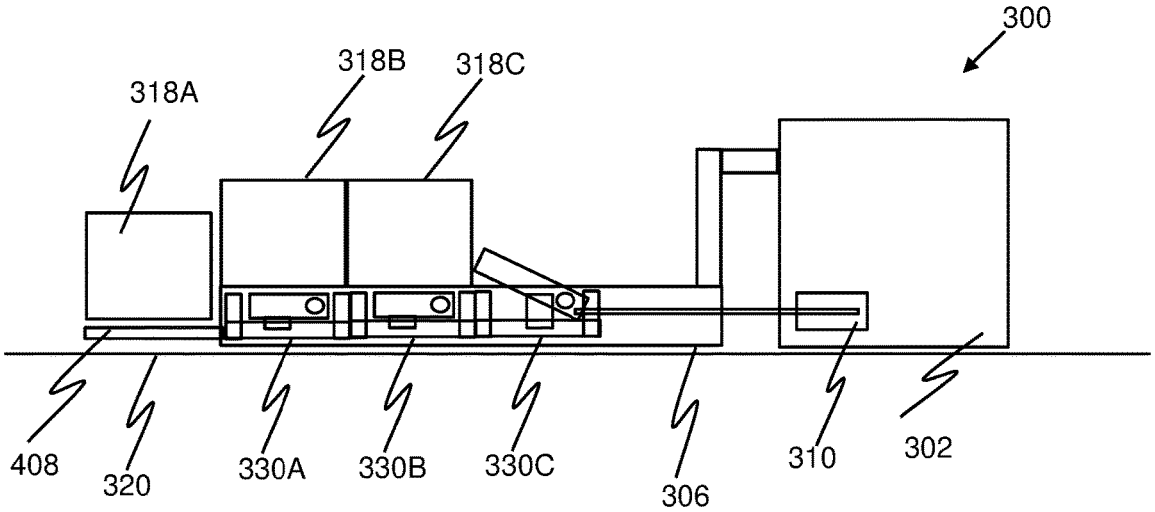
Figure 4C:
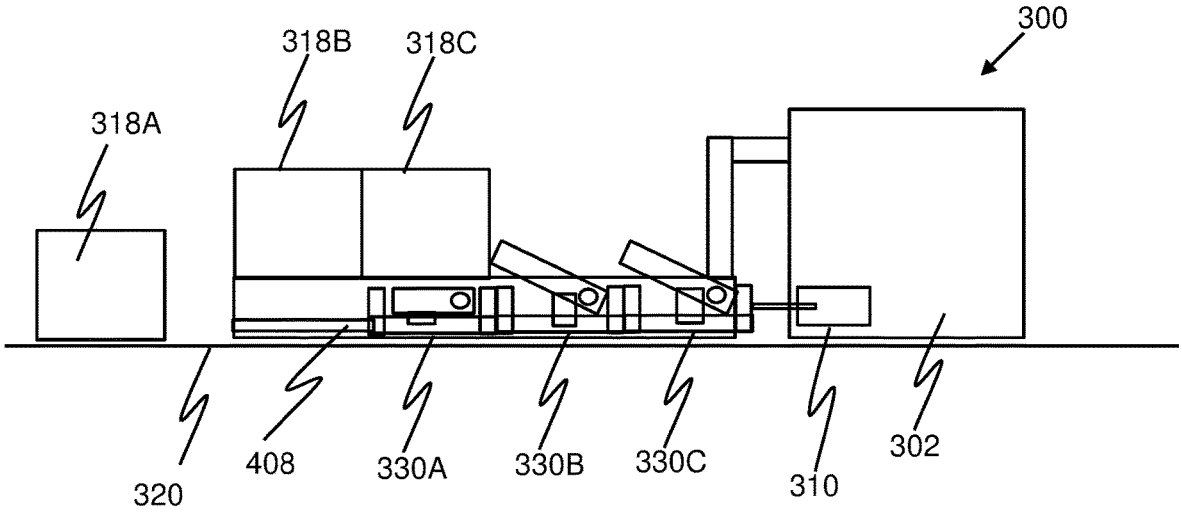

Referring to FIG. 4A, 4B and 4C, there is shown an embodiment, wherein the movable support-members 308 comprise an extension plate 408. The extension plate 408 protrudes as indicated in FIG. 4B when the moveable support-member 308 is moved during forward phase. The sleeper 318 is released from the fixed support-members 306 and it drops on top of the extension plate 408. Referring to FIG. 4C, as the movable support-member 308 is in its backwards phase, the extension plate 408 is pulled away from under the sleeper 318A thus placing the sleeper on the ballast-bed 320.

Figure 5:
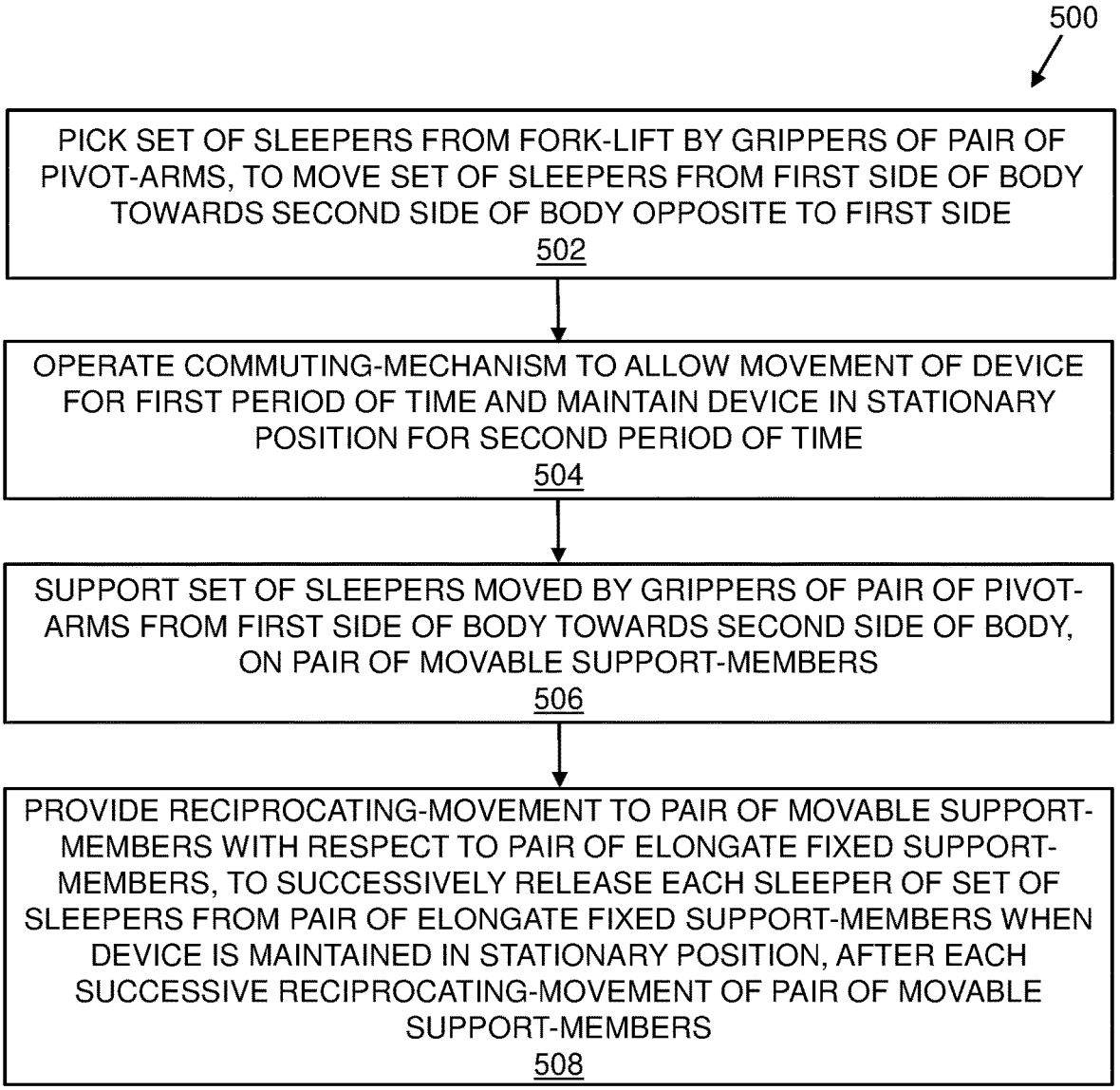
FIG. 5 is an illustration of steps of a method for laying sleepers on a ballast-bed for railroad construction, in accordance with an embodiment of the present disclosure.

Referring to FIG. 5, there is shown steps of a method 500 for laying sleepers on a ballast-bed for railroad construction, in accordance with an embodiment of the present disclosure. At a step 502, the set of sleepers are picked from the fork-lift by the grippers of the pair of pivot-arms, to move the set of sleepers from the first side of the body towards the second side of the body opposite to the first side. At a step 504, the commuting-mechanism is operated to allow movement of the device for the first period of time and maintaining the device in the stationary position for the second period of time. At a step 506, the set of sleepers moved are supported by the grippers of the pair of the pivot-arms from the first side of the body towards the second side of the body, on the pair of movable support-members. At a step 508, the reciprocating-movement is provided to the pair of movable support-members with respect to the pair of elongated fixed support-members, to successively release each sleeper of the set of sleepers from the pair of elongated fixed support-members when the device is maintained in the stationary position, after each successive reciprocating-movement of the pair of movable support-members.

The steps 502 to 508 are only illustrative and other alternatives can also be provided where one or more steps are added, one or more steps are removed, or one or more steps are provided in a different sequence without departing from the scope of the claims herein. For example, the method comprises releasing by the pair of movable support-members a sleeper supported at a distal end of the pair of elongated fixed support-members, during a forward phase of the reciprocating-movement of the pair of movable support-members, and retracting the pair of movable support-members towards the body, during a backward phase of the reciprocating-movement of the pair of movable support-members. In another example, each of the plurality of spring-loaded elements comprises a hollow body, a pusher arm pivotally coupled to the hollow body, and a spring coupled to each of the hollow body and the pusher arm, and wherein the method comprises allowing the spring-loaded element to attain the closed-state when the spring contracts and the pusher arm is pivotally lowered towards the hollow body, and allowing the spring-loaded element to attain the released-state when the spring expands and the pusher arm is pivotally raised away from the hollow body. In yet another example, the method comprises allowing at least one pair of the spring-loaded elements to attain the released-state during the forward phase of the reciprocating-movement of the pair of movable support-members, for enabling release of the sleeper supported at the distal end of the pair of elongated fixed support-members, and simultaneously maintaining the remaining spring-loaded elements in the closed-state; and allowing another pair from the remaining spring-loaded elements in the closed-state to attain the released-state during the backward phase of the reciprocating-movement of the pair of movable support-members, for enabling release of the remaining at least one sleeper of the set of sleepers.

In one example, the device further comprises at least one actuator operatively coupled to each of the pair of movable support-members, and wherein the method comprises operating the actuator for providing the reciprocating-movement to the pair of movable support-members. In another example, the fork-lift is operated to lift another set of sleepers above the ballast-bed to be received by the grippers of the pair of pivot-arms, before a last sleeper of the set of sleepers supported on the pair of elongated fixed support-members has been released. In yet another example, the method further comprises changing the first period of time when the device is allowed to move via the commuting-mechanism, to change a distance between release of each successive sleeper of the set of sleepers from the pair of elongated fixed support-members.

Modifications to embodiments of the present disclosure described in the foregoing are possible without departing from the scope of the present disclosure as defined by the accompanying claims. Expressions such as "including", "comprising", "incorporating", "have", "is" used to describe and claim the present disclosure are intended to be construed in a non-exclusive manner, namely allowing for items, components or elements not explicitly described also to be present. Reference to the singular is also to be construed to relate to the plural.

The invention claimed is:

1. A device for laying sleepers on a ballast-bed for railroad construction, the device comprising:

a body having a commuting-mechanism, wherein the commuting-mechanism is configured to allow movement of the device;

a fork-lift arranged on a first side of the body, wherein the fork-lift is configured to lift and hold at least one set of sleepers above the ballast-bed;

a pair of pivot-arms movably coupled the body, wherein each of the pivot-arms comprises a gripper, and wherein the grippers of the pair of pivot-arms are configured to pick a set of sleepers from the fork-lift and to move the set of sleepers from the first side of the body towards a second side of the body opposite to the first side;

wherein a cradle-arrangement mounted on the second side of the body, wherein the cradle-arrangement comprises:

a pair of elongated fixed support-members extending from the second side of the body and spaced apart from each other; and a pair of movable support-members, wherein each of the movable support-members comprises a plurality of spring-loaded elements configured to attain a closed-state and a released-state, wherein the pair of movable support-members includes an extension plate for receiving a released sleeper during a forward phase, and wherein:

the pair of elongated fixed support-members is configured to support thereon the set of sleepers moved by the grippers of the pair of the pivot-arms from the first side of the body towards the second side of the body, and the pair of movable support-members is configured to have a reciprocating-movement with respect to the pair of elongated fixed support-members to successively release one sleeper of the set of sleepers at a time from the pair of elongated fixed support-members.

2. The device according to claim 1, wherein during the forward phase of the reciprocating-movement of the pair of movable support-members, a sleeper supported by the pair of elongated fixed support-members is released by the pair of movable support-members, and during a backward phase of the reciprocating-movement of the pair of movable support-members, the pair of movable support-members retract towards the body.

3. The device according to claim 1, wherein each of the plurality of spring-loaded elements comprises a hollow body, a pusher arm pivotally coupled to the hollow body, and a spring coupled to each of the hollow body and the pusher arm, and wherein;

the spring-loaded element attains the closed-state when the spring contracts and the pusher arm is pivotally lowered towards the hollow body, and the spring-loaded element attains the released-state when the spring expands and the pusher arm is pivotally raised away from the hollow body.

4. The device according to claim 3, wherein during the forward phase of the reciprocating-movement of the pair of movable support-members, at least one pair of the spring-loaded elements is allowed to attain the released-state for enabling release of the sleeper supported by elongated fixed support-members and remaining spring-loaded elements remain in the closed-state, and during the backward phase of the reciprocating-movement of the pair of movable support-members, another pair from the remaining spring-loaded elements in the closed-state is allowed to attain the released-state for enabling release of the remaining at least one sleeper of the set of sleepers.

5. The device according to claim 1, wherein the commuting-mechanism comprises at least one of a plurality of drive-wheels or a caterpillar-track arrangement.

6. The device according to claim 1, wherein each of the pair of pivot-arms includes a first end movably coupled to an intermediate portion of the body, and a second end mounted with the gripper.

7. The device according to claim 1, further comprising at least one actuator operatively coupled to each of the pair of movable support-members, for providing the reciprocating-movement to the pair of movable support-members.

8. The device according to claim 7, wherein the at least one actuator is a hydraulic actuator.

9. The device according to claim 1, wherein the fork-lift is configured to lift another set of sleepers above the ballast-bed to be received by the grippers of the pair of pivot-arms, before a last sleeper of the set of sleepers supported on the pair of elongated fixed support-members has been released.

10. The device according to claim 1, wherein for a first period of time the commuting mechanism (106) is configured to move the device at a set first speed and the reciprocating movement has a set frequency.

11. A The device according to claim 1, wherein the commuting mechanism is configured to move the device for a first period of time, and maintain the device in a stationary position for a second period of time and the reciprocating movement is configured to take place during the second period of time.

12. The device according to claim 11, wherein the first period of time when the device is allowed to move is changed via the commuting-mechanism, to change a distance between release of each successive sleeper of the set of sleepers from the pair of elongated fixed support-members.

13. A method for operating a device for laying sleepers on a ballast-bed for railroad construction, the device comprising a body having a commuting-mechanism; a fork-lift arranged on a first side of the body, wherein the fork-lift is configured to lift and hold at least one set of sleepers above the ballast-bed; a pair of pivot-arms movably coupled the body, wherein each of the pivot-arms comprises a gripper; a cradle-arrangement mounted on the second side of the body, the cradle-arrangement comprising a pair of elongated fixed support-members extending from the second side of the body and spaced apart from each other; and a pair of movable support-members, each of the movable support-members comprising a plurality of spring-loaded elements configured to attain a closed-state and a released-state, and wherein the pair of movable support-members includes an extension plate for receiving a released sleeper during a forward phase, the method comprising:

picking a set of sleepers from the fork-lift by the grippers of the pair of pivot-arms and moving the set of sleepers from the first side of the body towards a second side of the body opposite to the first side;

operating the commuting-mechanism to allow movement of the device;

supporting the set of sleepers moved by the grippers of the pair of the pivot-arms from the first side of the body towards the second side of the body, on the pair of elongated fixed support-members; and providing a reciprocating-movement to the pair of movable support-members with respect to the pair of elongated fixed support-members, to successively release one sleeper of the set of sleepers at a time from the pair of elongated fixed support-members.

14. The method according to claim 13, wherein the method comprises releasing by the pair of movable support-members a sleeper supported by the pair of elongated fixed support-members, during the forward phase of the reciprocating-movement of the pair of movable support-members, and retracting the pair of movable support-members towards the body, during a backward phase of the reciprocating-movement of the pair of movable support-members.

* * * * *